US008261584B2

(12) United States Patent
Yang

(10) Patent No.: US 8,261,584 B2
(45) Date of Patent: Sep. 11, 2012

(54) REVERSIBLE MORTISE LOCK

(75) Inventor: Ming Gui Yang, Guangdong (CN)

(73) Assignee: Betteli Inc Hong Kong, Hong Kong (HK)

( * ) Notice: Subject to any disclaimer, the term of this patent is extended or adjusted under 35 U.S.C. 154(b) by 209 days.

(21) Appl. No.: 12/836,712

(22) Filed: Jul. 15, 2010

(65) Prior Publication Data

US 2012/0011905 A1 Jan. 19, 2012

(51) Int. Cl.
*E05B 59/00* (2006.01)
*E05B 63/14* (2006.01)

(52) U.S. Cl. ..... 70/107; 70/448; 70/451; 70/462; 70/461; 70/466; 70/DIG. 79; 292/244

(58) Field of Classification Search ..... 70/107, 70/448, 451, 462, 461, 466, DIG. 79; 292/244
See application file for complete search history.

(56) References Cited

U.S. PATENT DOCUMENTS

| | | | | | |
|---|---|---|---|---|---|
| 81,529 | A * | 8/1868 | Oaks | 292/244 |
| 85,497 | A * | 12/1868 | Whitney | 292/244 |
| 110,637 | A * | 1/1871 | Dotzenroth | 292/244 |
| 1,586,223 | A * | 5/1926 | Sheinman | 70/128 |
| 2,823,538 | A * | 2/1958 | Fresard | 70/462 |
| 4,583,382 | A * | 4/1986 | Hull | 70/107 |
| 4,695,082 | A * | 9/1987 | Marks | 70/486 |
| 4,696,174 | A * | 9/1987 | Marks | 70/451 |
| 4,854,618 | A * | 8/1989 | Webster | 292/244 |
| 4,988,133 | A * | 1/1991 | Shih | 70/486 |
| 5,123,684 | A * | 6/1992 | Yeh | 292/244 |
| 5,678,870 | A * | 10/1997 | Pelletier | 292/244 |
| 5,813,255 | A * | 9/1998 | Tell et al. | 70/107 |
| 6,393,878 | B1 * | 5/2002 | Fayngersh et al. | 70/107 |
| 6,688,063 | B1 | 2/2004 | Lee et al. | |
| 7,117,639 | B2 | 10/2006 | Abdella et al. | |
| 7,510,222 | B2 * | 3/2009 | Hodgin et al. | 292/244 |
| 2008/0246288 | A1 * | 10/2008 | Hodgin et al. | 292/244 |
| 2010/0263418 | A1 * | 10/2010 | Moon | 292/61 |

* cited by examiner

*Primary Examiner* — Suzanne Barrett
*Assistant Examiner* — David E Sosnowski
(74) *Attorney, Agent, or Firm* — McKee, Voorhees & Sease, P.L.C.

(57) ABSTRACT

The reversible mortise lock of the present invention can be installed on either the left or right side edges of a door opposite the door hinges. The lock includes a housing with a live bolt pivotally and slidably mounted in the housing. The live bolt slides between an extended position beyond the housing and a fully retracted position within the housing. When fully retracted, the live bolt can be rotated 180° so that the beveled face of the live bolt can be reversed. A finger pivotally mounted within the housing blocks full retraction of the live bolt when the mortise lock is installed in the door.

28 Claims, 6 Drawing Sheets

REVERSIBLE MORTISE LOCK

BACKGROUND OF THE INVENTION

Reversible doors which may be hinged on either the left or right side are well known. For buildings or rooms occupied by people, the doors, including primary doors and screen doors, typically have a mortise lock with a live bolt actuated by the door handle. The live bolt has a beveled edge facing the door frame or closing direction of the door. However, unlike reversible doors, mortise locks typically are not reversible, which necessitates right-hand and left-hand mortise locks to be used, depending upon which side of the door is hinged. Thus, there is a need to manufacture both left and right-hand mortise locks, and to maintain an inventory of such locks for sale. These dual manufacturing and inventory requirements lead to additional costs.

Therefore, a primary objective of the present invention is the provision of a reversible mortise lock which can be used on either a left-hand or right-hand side of a door.

Another objective of the present invention is the provision of a mortise lock having a reversible live bolt so that the lock can be used on opposite side edges of the door.

Still another objective of the present invention is the provision of a mortise lock having a live bolt which is slidably and pivotally mounted in the housing for orientation in opposite directions.

Yet another objective of the present invention is the provision of an improved mortise lock which can be quickly and easily changed from a right-hand lock to a left-hand lock.

Another objective of the present invention is the provision of a reversible mortise lock having a live bolt which can be rotated 180° front to back.

Another objective of the present invention is the provision of a reversible mortise lock wherein the live bolt is locked against reversibility once the lock is installed in a door edge.

Still another objective of the present invention is the provision of a reversible mortise lock which can be changed from a right-hand to left-hand orientation prior to installation in the door.

A further objective of the present invention is the provision of a mortise lock having a live bolt which can be reversed without the use of tools for installation on left and right-hand side edges of the door.

Still another objective of the present invention is the provision of a reversible mortise lock which is economical to manufacture, and durable and safe in use.

These and other objectives will become apparent from the following description of the invention.

BRIEF SUMMARY OF THE INVENTION

The reversible mortise lock of the present invention includes a housing with a live bolt pivotally and slidably mounted in the housing for movement between extended and retracted positions. A mortise plate is mounted on the housing and has an opening through which the live bolt extends. An actuator connected to the door handle moves the live bolt from the extended position beyond the mortise plate when the door is closed to a partially retracted position substantially flush with the mortise plate allowing opening of the door from the door frame. A finger pivotally mounted in the housing moves between a first position to limit retraction of the live bolt to the partially retracted position flush with the mortise plate and a second position to allow full retraction of the live bolt beyond the mortise plate. The finger is in the first position when the mortise lock is installed on either side edge of the door. Prior to installation, the finger can be moved by gravity to the second position simply by turning the mortise lock 180° top to bottom. When the finger is in the second position, the live bolt can be retracted beyond the mortise plate and then rotated 180° top to bottom so that the beveled edge faces the opposite direction. When the mortise lock is again turned 180° top to bottom, gravity causes the finger to fall to the first position, thereby preventing the live bolt from being fully retracted beyond the mortise plate, such that the live bolt cannot be rotated to the opposite direction.

DETAILED DESCRIPTION OF THE PREFERRED EMBODIMENTS

Figure 5:
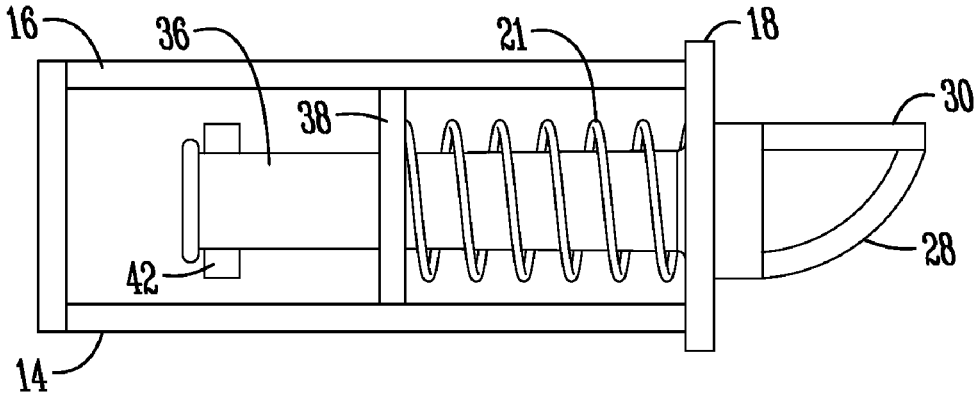
FIG. 5 is a top view of the mortise lock with the live bolt oriented for one door edge, and with the finger removed for clarity.
Figure 6:
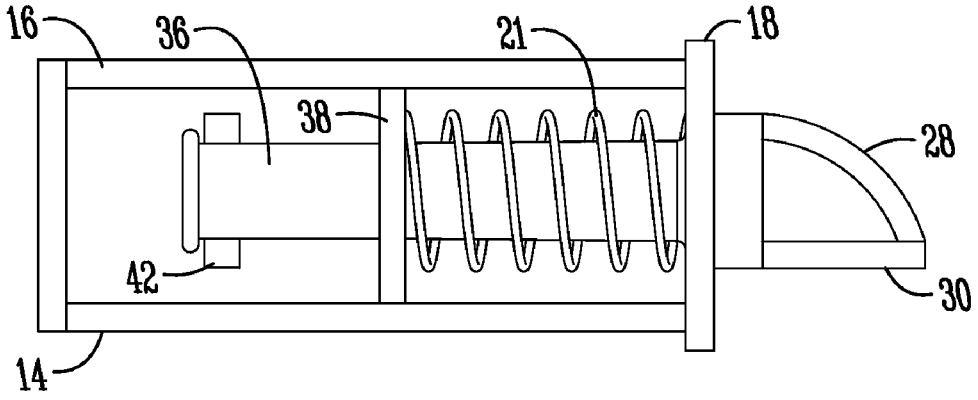
FIG. 6 is a top view of the mortise lock with the live bolt rotated 180° from FIG. 5 for use on the opposite door edge, with the finger removed for clarity.
Figure 7:
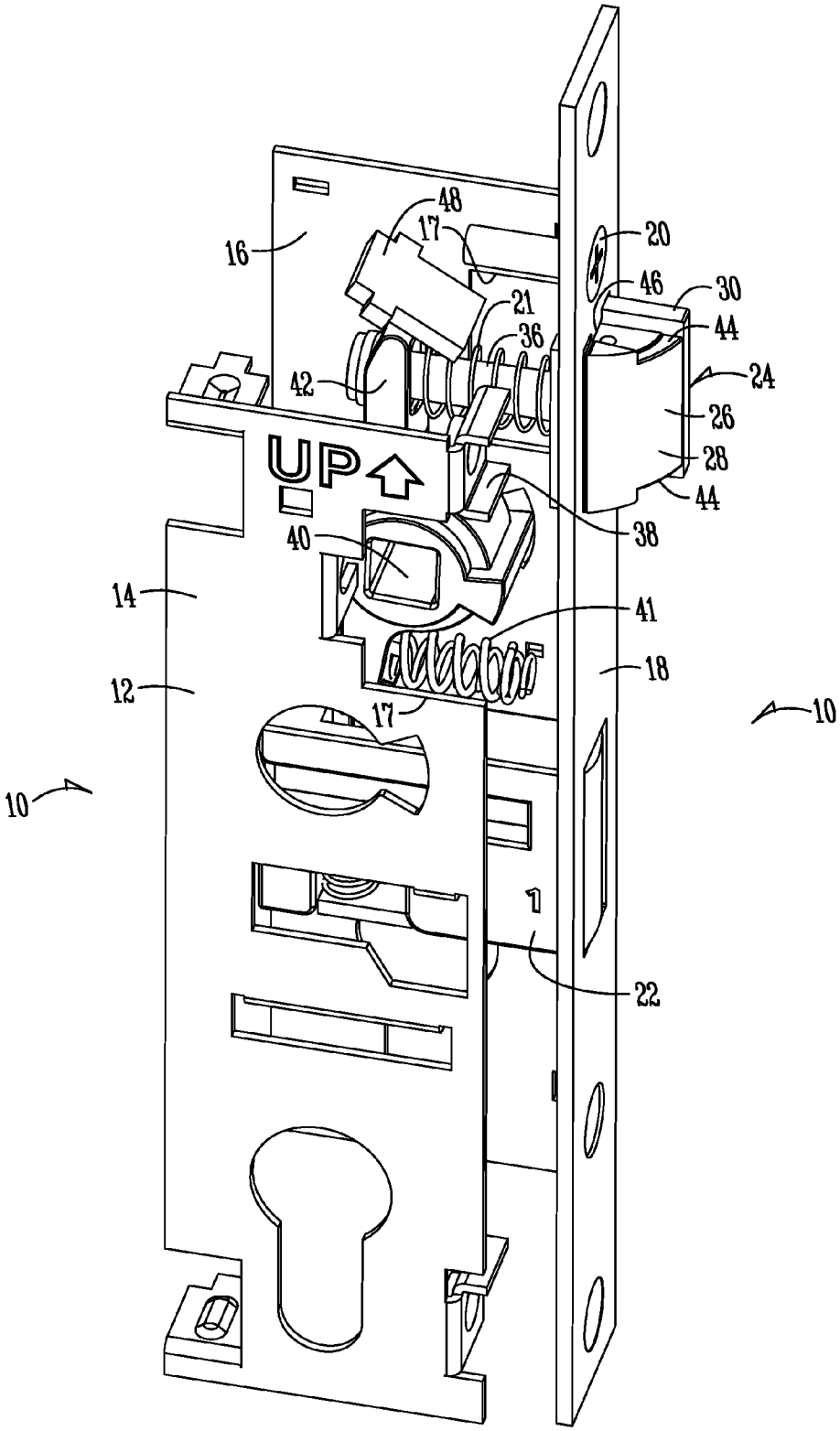
FIG. 7 is a partially exploded perspective view of the mortise lock of the present invention.

The reversible mortise lock of the present invention is generally designated in the drawings by the reference numeral 10. The lock 10 includes a housing 12 with opposite side plates 14, 16 defining a chamber or compartment within the housing 12. A mortise plate 18 is secured to one side edge of the housing 12 using screws or other fasteners 20. The mortise lock 10 may include an optional dead bolt 22 slidable between a retracted position, as seen in FIG. 5, and an extended position (not shown). The dead bolt 22 can be moved between the extended and contracted positions using an actuator (not shown).

The mortise lock 10 of the present invention includes a live bolt 24 slidably and rotatably mounted within the housing 12. The live bolt 24 includes a head 26 with a beveled or curved front face 28, a flat rear face 30, and opposite upper and lower ends 32, 34. The head 26 of the live bolt 24 is mounted on a shaft 36 extending into the housing 12. The side wall 14 of the housing 12 has an inwardly turned tab 38 with a recess or hole through which the shaft 36 of the live bolt slidably extends.

An actuator 40 controls the sliding movement of the live bolt 24 between an extended position beyond the mortise plate 18 and a retracted position. A spring 21 normally biases the live bolt 24 to the extended position. The actuator 40 is pivotally mounted in the housing 12 and includes a square hole for receiving a drive shaft of the interior and exterior handles (not shown) of the door. The actuator 40 includes an arm 42 extending upwardly with an opening through which the live bolt shaft 36 extends through. The rear end of the shaft 36 includes an enlarged rim, bead, lip or flange to retain the shaft 36 on the arm 42 of the actuator 40. When a door handle is turned, the drive shaft rotates the actuator 40, which in turn pivots the arm 42 rearwardly so as to pull the shaft 36 rearwardly, thereby retracting the head 26 of the live bolt 24 from the extended position (shown in FIG. 5) to a partially retracted position wherein the forward edge of the head 26 is substantially flush with the outer or front surface of the mortise plate 18. This retraction of the live bolt 24 allows the door to be opened from a closed position. A spring 41 normally biases the actuator 40 to a neutral or rest position. The upper and lower ends 32, 34 of the head 26 of the live bolt 24 include a notch or groove 44 which receives a tongue 46 on the mortise plate 18, thereby forming a tongue and groove assembly to guide the sliding movement of the live bolt 24 through the opening of the mortise plate 18.

Figure 1:
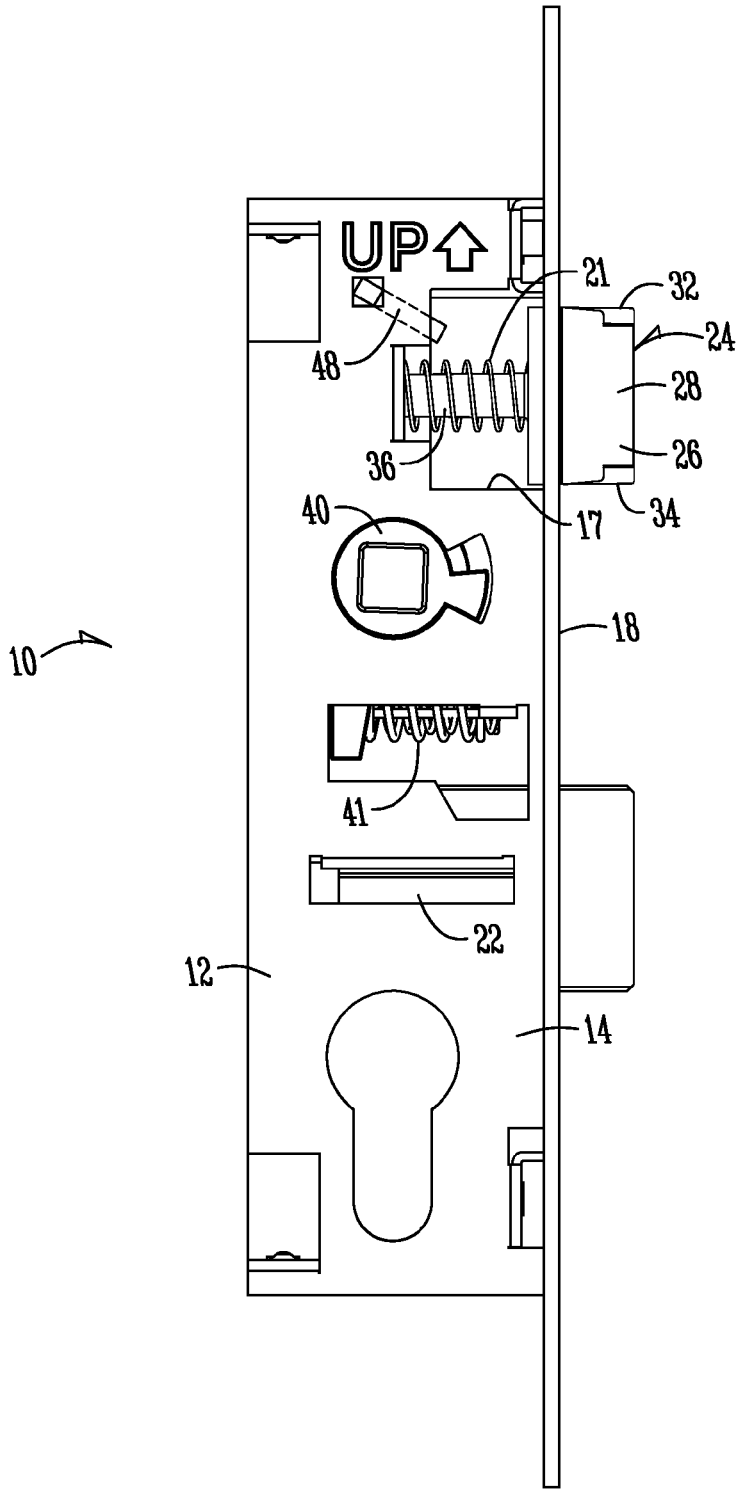
FIG. 1 is a side elevation view of the mortise lock of the present invention in its normal position ready for installation in one side edge of a door, with the live bolt fully extended, and the dead bolt extended.
Figure 2:
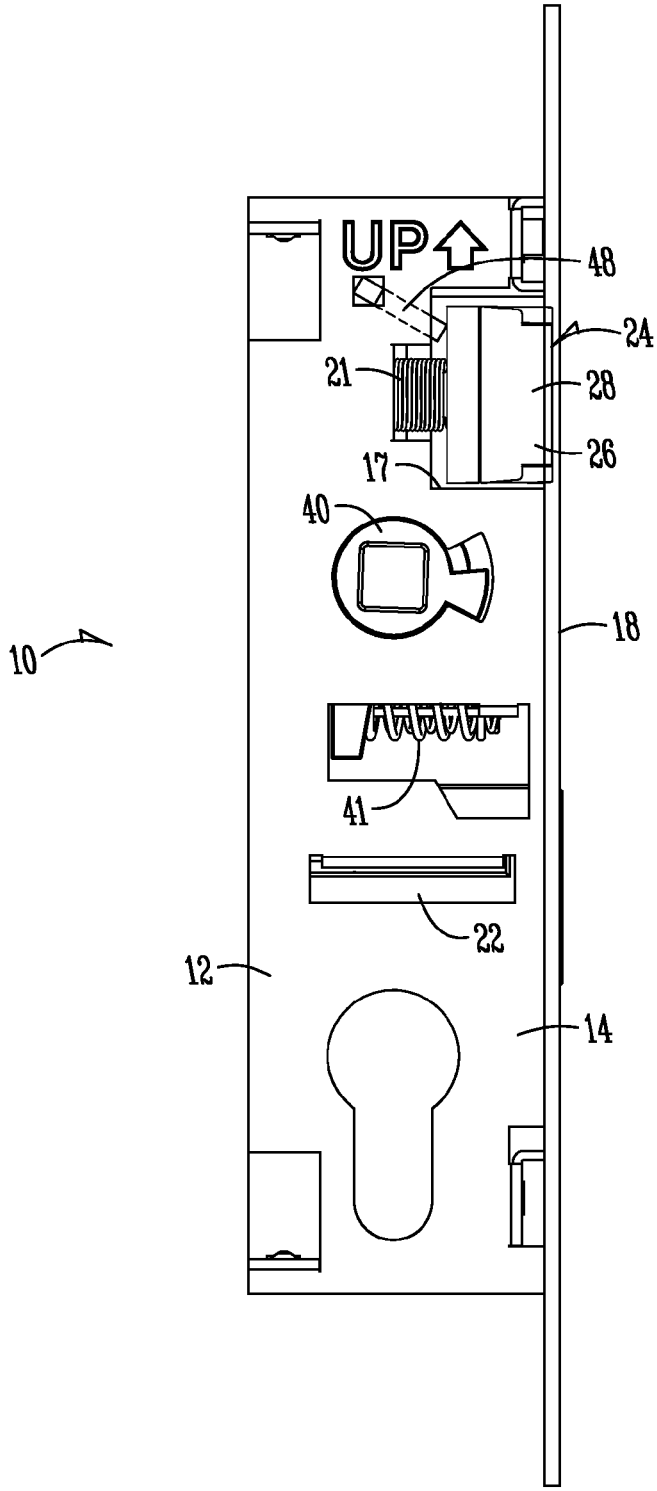
FIG. 2 is a view similar to FIG. 1 with the live bolt partially retracted, and the leading edge of the live bolt flush with the outer surface of the mortise plate, and the dead bolt retracted.
Figure 3:
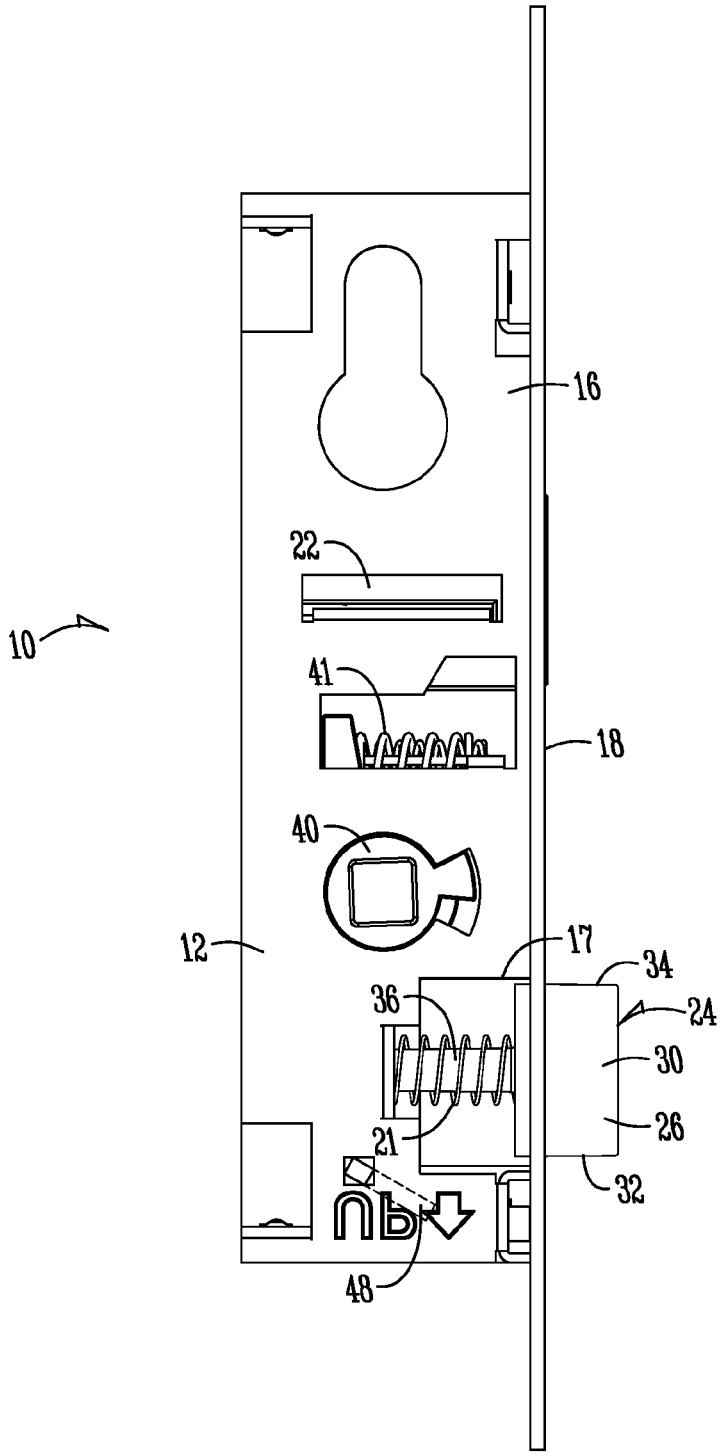
FIG. 3 is a side elevation view of the mortise lock of the present invention turned 180° top to bottom prior to installation in the door, with the live bolt in the fully extended position.
Figure 4:
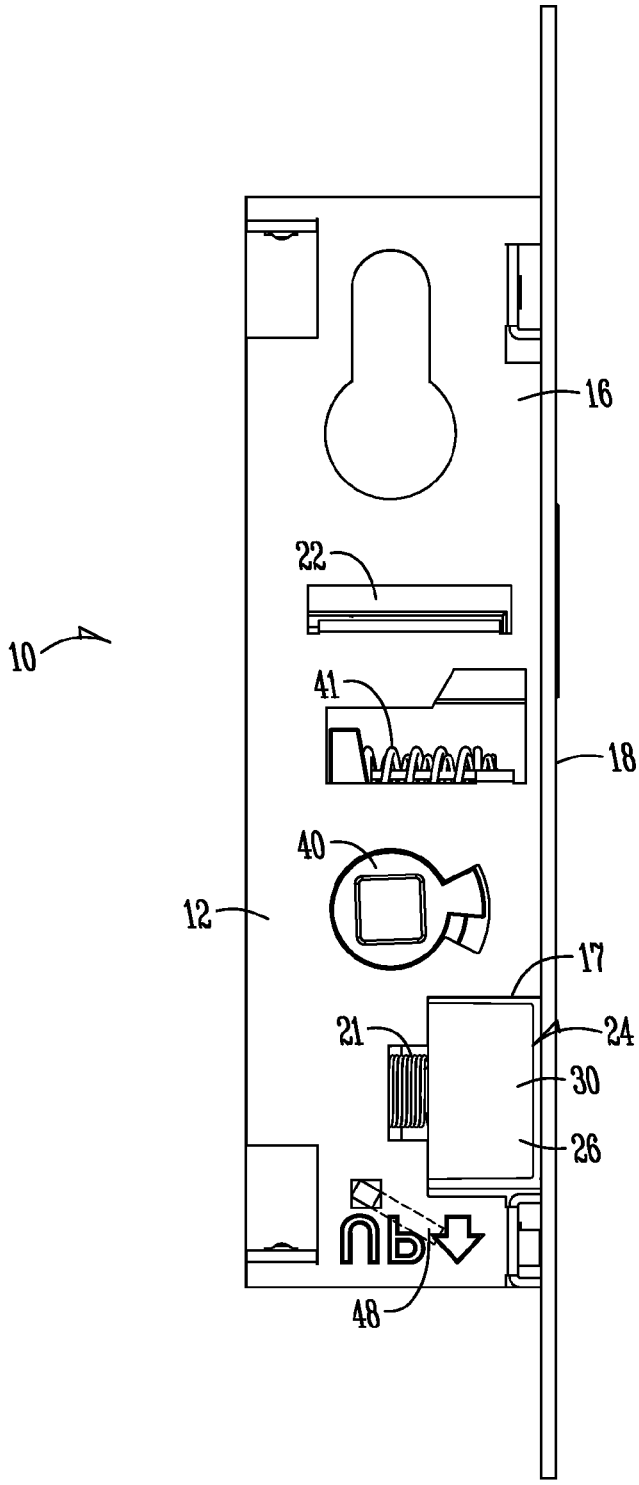
FIG. 4 is a view similar to FIG. 3 with the live bolt in a fully retracted position to allow rotation of the live bolt 180° about a horizontal axis.

The mortise lock 10 also includes a finger 48 pivotally mounted between the side walls 14, 16 of the housing 12 adjacent the live bolt 24. The finger 48 pivots about a substantially horizontal axis between first and second positions. The first position of the finger 48 is shown in FIGS. 1 and 2. In the first position, the finger 48 engages the back or rearward side of the head 26 of the live bolt 24, thereby blocking or stopping the retraction of the live bolt 24 by the actuator 40 so that the front or outer edge of the live bolt 24 is substantially flush with the mortise plate 18 and does not retract beyond the mortise plate 18. The finger 48 remains in this first position when the mortise lock 10 is in an upright position for installation in a door edge and after installation. If the mortise lock 10 is to be installed on the opposite door edge, before installation, the mortise lock 10 can be turned upside down, top to bottom, as shown in FIGS. 3 and 4. This 180° rotation of the mortise lock 10 about a horizontal axis allows the finger 48 to pivot by gravity to a second position, shown in FIGS. 3 and 4. In this second position, the finger 48 does not engage or block the live bolt 24, which can be manually retracted beyond the mortise plate 18. In this fully retracted position, the live bolt 24 can be rotated about the axis of the shaft 36 180°, such that the head 26 is reversed relative to the housing 12, with the beveled front face 28 being disposed in the opposite direction from that shown in FIGS. 1 and 2. The housing side walls 14, 16 each have a cutout portion 17 to allow rotation of the live bolt 24 about the axis of the shaft 36. The mortise lock 10 is then turned back to its upright position, wherein the finger 48 again pivots by gravity to its first position to block retraction of the live bolt 24 beyond the mortise plate 18.

Thus, the beveled face 28 of the live bolt 24 can be selectively oriented towards the right or left side of the mortise lock 10 for installation of the lock on either the left or right side edge of a door, opposite the door hinges.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A mortise lock, comprising:
a housing;
a live bolt slidably mounted in the housing for movement between extended and retracted positions;
an actuator for moving the live bolt;
a mortise plate mounted to the housing and having an opening through which the live bolt extends;
a finger pivotally mounted in the housing for movement between a first position to limit retraction of the live bolt and a second position to allow full retraction of the live bolt beyond the mortise plate;
the finger pivoting by gravity between the first and second positions; and
the live bolt being pivotally mounted in the housing for 180° rotation when the finger is in the second position and the live bolt is fully retracted, whereby the mortise lock is usable on opposite edges of the door.

2. The mortise lock of claim 1 wherein the finger is in the first position when the housing is upright and the finger is in the second position when the housing is inverted.

3. The mortise lock of claim 1 further comprising a dead bolt mounted in the housing.

4. The mortise lock of claim 1 wherein the live bolt is spring biased towards the extended position.

5. A mortise lock, comprising:
a housing;
a live bolt pivotally and slidably mounted in the housing;
the live bolt sliding between an extended position beyond the housing and a fully retracted position within the housing;
a finger pivotally mounted on the housing for movement between a first position to engage the live bolt upon partial retractions and preclude further retraction to the fully retracted position when the mortise lock is installed and a second position disengaged from the live bolt before the mortise lock is installed to allow rotation of the live bolt;
the finger pivoting by gravity between the first and second positions; and
the live bolt being rotatable 180° when in the fully retracted position to reverse the mortise lock from left-handed to right-handed.

6. The mortise lock of claim 5 wherein the finger is in the first position when the housing is upright and the finger is in the second position when the housing is inverted.

7. The mortise lock of claim 5 further comprising a dead bolt mounted in the housing.

8. The mortise lock of claim 5 wherein the live bolt is spring biased towards the extended position.

9. The mortise lock of claim 5 further comprising a mortise plate mounted on the housing and having an opening through which the live bolt extends when in the extended position.

10. The mortise lock of claim 9 wherein the live bolt has a leading edge which is substantially flush with the mortise plate when the live bolt engages the finger and is behind the mortise plate when in the fully retracted position.

11. A method of reversing a mortise lock from left to right sides, the mortise lock having a housing with a live bolt rotatably and slidably mounted in the housing, the method comprising:
sliding the live bolt from an extended position outside the housing to a retracted position within the housing; then
rotating the live bolt 180° top to bottom;
moving a finger from a blocking position to a non-blocking position before the mortise lock is installed for rotating, the live bolt; and
moving the finger between the blocking and non-blocking positions by gravity;
then sliding the live bolt to the extended position.

12. The method of claim 11 further comprising blocking the live bolt from movement to the retracted position after the mortise lock is installed in a door.

13. The method of claim 12 wherein the blocking is accomplished with the finger engaging the live bolt upon partial retraction from the extended position.

14. The method of claim 11 wherein the finger moves between the blocking and non-blocking position by turning the housing 180° top to bottom about a horizontal axis.

15. A mortise lock, comprising:

a housing;

a live bolt slidably mounted in the housing for movement between extended and retracted positions;

an actuator for moving the live bolt;

a mortise plate mounted to the housing and having an opening through which the live bolt extends;

a finger pivotally mounted in the housing for movement between a first position to limit retraction of the live bolt and a second position to allow full retraction of the live bolt beyond the mortise plate;

the live bolt being pivotally mounted in the housing for 180° rotation when the finger is in the second position and the live bolt is full retracted, whereby the mortise lock is usable on opposite edges of the door; and the finger being in the first position when the housing is upright and the finger being in the second position when the housing is inverted.

16. The mortise lock of claim 15 wherein the finger pivots by gravity between the first and second positions.

17. The mortise lock of claim 15 further comprising a dead bolt mounted in the housing.

18. The mortise lock of claim 15 wherein the live bolt is spring biased towards the extended position.

19. A mortise lock, comprising:

a housing; and a live bolt pivotally and slidably mounted in the housing;

the live bolt sliding between an extended position beyond the housing and a fully retracted position within the housing;

the live bolt being rotatable 180° when in the fully retracted position to reverse the mortise lock from left-handed to right-handed;

a finger pivotally mounted on the housing for movement between a first position to engage the live bolt upon partial retractions and preclude further retraction to the fully retracted position when the mortise lock is installed and a second position disengaged from the live bolt before the mortise lock is installed to allow rotation of the live bolt; and the finger being in the first position when the housing is upright and the finger being in the second position when the housing is inverted.

20. The mortise lock of claim 19 wherein the finger pivots by gravity between the first and second positions.

21. The mortise lock of claim 19 further comprising a dead bolt mounted in the housing.

22. The mortise lock of claim 19 wherein the live bolt is spring biased towards the extended position.

23. The mortise lock of claim 19 further comprising a mortise plate mounted on the housing and having an opening through which the live bolt extends when in the extended position.

24. The mortise lock of claim 23 wherein the live bolt has a leading edge which is substantially flush with the mortise plate when the live bolt engages the finger and is behind the mortise plate when in the fully retracted position.

25. A method of reversing a mortise lock from left to right sides, the mortise lock having a housing with a live bolt rotatably and slidably mounted in the housing, the method comprising:

sliding the live bolt from an extended position outside the housing to a retracted position within the housing; then rotating the live bolt 180° top to bottom;

then sliding the live bolt to the extended position;

moving a finger from a blocking position to a non-blocking position before the mortise lock is installed for rotating the live bolt; and moving the finger between the blocking and non-blocking position by turning the housing 180° top to bottom about a horizontal axis.

26. The method of claim 25 further comprising blocking the live bolt from movement to the retracted position after the mortise lock is installed in a door.

27. The method of claim 25 wherein the blocking is accomplished with the finger engaging the live bolt upon partial retraction from the extended position.

28. The method of claim 25 wherein the finger moves between the blocking and non-blocking positions by gravity.

* * * * *